US007356929B2

(12) United States Patent
Nakano

(10) Patent No.: US 7,356,929 B2
(45) Date of Patent: Apr. 15, 2008

(54) ROTARY TYPE ELECTRIC SHAVER

(75) Inventor: Tsuyoshi Nakano, Matsumoto (JP)

(73) Assignee: Izumi Products Company, Nagano (JP)

( * ) Notice: Subject to any disclaimer, the term of this patent is extended or adjusted under 35 U.S.C. 154(b) by 0 days.

(21) Appl. No.: 11/353,710

(22) Filed: Feb. 14, 2006

(65) Prior Publication Data

US 2006/0179660 A1 Aug. 17, 2006

(30) Foreign Application Priority Data

Feb. 14, 2005 (JP) ..... 2005-036594

(51) Int. Cl.
*B26B 19/16* (2006.01)

(52) U.S. Cl. ..... 30/43.6; 30/346.51

(58) Field of Classification Search ..... 30/43.6, 30/346.51

See application file for complete search history.

(56) References Cited

U.S. PATENT DOCUMENTS 2,824,367 A * 2/1958 McWilliams ..... 30/41.5
2,877,548 A * 3/1959 Starre ..... 30/346.51
3,279,057 A * 10/1966 Sanders ..... 30/43.3
5,119,558 A * 6/1992 van Erp et al. ..... 30/43.6
5,329,702 A * 7/1994 Uchiyama et al. ..... 30/346.51
5,390,416 A * 2/1995 Uchiyama et al. ..... 30/43.6

FOREIGN PATENT DOCUMENTS

| | | |
|---|---|---|
| DE | 1004072 | 5/1957 |
| EP | 0279088 | 8/1988 |
| EP | 0428211 | 5/1991 |
| FR | 2085373 | 12/1971 |
| JP | 57-31888 | 2/1982 |
| JP | 63-194691 | 8/1988 |

* cited by examiner

*Primary Examiner*—Hwei-Siu C. Payer
(74) *Attorney, Agent, or Firm*—William L. Androlia; H. Henry Koda

(57) ABSTRACT

A rotary shaver including an outer cutter frame (18) provided on a shaver main body (10), an outer cutter (14) that is installed in this outer cutter frame (18) and has ring-shaped thin layer portions (28*a*, 28*b*) whose upper surfaces are the shaving surfaces, and an inner cutter (16) that has cutter bodies (38) that rotates and make sliding contact with the lower surface of the thin layer portions of the outer cutter to cut hair that entered hair introduction openings (30*a*, 30*b*) formed in the thin layer portions; wherein the hair introduction openings have a slit shape extending in substantially the radial direction of the thin layer portions, and the cutting edge angle (p, q) at the lower end(s) of the side wall surface(s) of the hair introduction openings (30*a*, 30*b*) defined by the ribs (32*a*, 32*b*) is an acute angle.

2 Claims, 5 Drawing Sheets

ROTARY TYPE ELECTRIC SHAVER

BACKGROUND OF THE INVENTION

1. Field of the Invention

The present invention relates to a rotary type electric shaver including an outer cutter(s) having a shaving surface on an upper surface of a ring-shaped thin layer portion thereof and an inner cutter(s) rotationally making sliding contact from below with the lower surface of the thin layer portion of the outer cutter(s), thus cutting whiskers (hair) advancing into a hair introduction opening formed in the thin layer portion.

2. Description of the Related Art

In an electric shaver of the type as described above, hair introduction openings are formed so as to transect the thin layer portion of an outer cutter in substantially the radial direction, and the hair introduction openings are formed in a slit shape of substantially constant width. Each hair introduction opening ("slit") conventionally has side wall surfaces that are perpendicular to the upper surface of the thin layer portion of the outer cutter in cross section that is substantially orthogonal to the lengthwise direction of the elongated opening. In other words, the shearing angle (cutting edge angle of the outer cutter), which is formed by the side wall surface of the hair introduction opening on the forefront side of the inner cutter rotational direction and by the inner cutter rotational direction near its lower end, is the right angles, as disclosed in Japanese Patent Application Laid-Open (Kokai) Nos. S57-31888 and S63-194691.

FIG. 7 shows, in a simple manner, the shape of hair introduction openings in cross-section substantially orthogonal to the lengthwise direction of the hair introduction openings. In FIG. 7, the reference numeral 1 is an outer cutter, and slit-shaped hair introduction openings 2 are located between neighboring ribs 3 and 3. The reference numeral 4 is an inner cutter, and this inner cutter 4 rotates in the direction of arrow F. In other words, arrow F is the rotational direction of the inner cutter (or the inner cutter rotational direction).

In this shown outer cutter 1 of the prior art, the shearing angle a (a cutting edge angle of the outer cutter 1), which is formed by the side wall surface 5 of the hair introduction opening 2 on the forefront side in the direction F of the rotation of the inner cutter 4 (or on the forefront side of the inner cutter rotational direction F) and by the inner cutter rotational direction F, is 90° (right angles). The cutting edge angle b, which is a shearing angle formed by the cutter (front) surface 6 of the inner cutter 4 on the leading edge side of the inner cutter rotational direction F and by the top end surface of the inner cutter 4, is an acute angle.

With the outer cutter 1 of the conventional rotary type electric shaver as shown in FIG. 7, the cutting edge angle a of the outer cutter 1 is 90° or is at the right angles with respect to the undersurface of the rib 3 with which the top end surface of the inner cutter 4 makes sliding contact. As a result, a whisker (hair) 7 that entered the hair introduction opening 2 touches the cutting edge 8 (tip of the cutting edge angle a) of the outer cutter 1 and is positioned there, thus being cut by the cutting edge 9 of the rotating inner cutter 4. In other words, the cutting edge 8 of the outer cutter 1 mainly functions to hold or support the hair 7 but does not actively contribute to cut the hair 7. As a result, the shaver cannot provide sharp and clean shaving.

BRIEF SUMMARY OF THE INVENTION

The present invention is to overcome the problems described above.

It is, therefore, a first object of the present invention to provide a rotary type electric that provides sharp and clean shaving of hair.

It is a second object of the present invention to provide a method for manufacturing an outer cutter that contributes to the shaver's sharp and clean shaving capabilities.

The above first object of the present invention is accomplished by a unique structure of the present invention for a rotary type electric shaver that includes an outer cutter frame which is provided on a shaver main body, an outer cutter which is installed in the outer cutter frame and has hair introduction openings in its ring-shaped thin layer portion whose upper surface forms a shaving surface, and an inner cutter which has cutter bodies making sliding contact with a lower surface of the thin layer portion and rotate to cut hair that entered the hair introduction openings; and in the present invention, the hair introduction openings have a shape of slit extending in the thin layer portion in substantially the radial direction of the ring-shaped thin layer portion, and the cutting edge, which is at the lower end of at least one of the side wall surfaces of the ribs defining the hair introduction openings, is formed at an acute angle in cross section taken substantially orthogonal to the lengthwise direction of the hair introduction opening.

In the structure of the present invention, as seen from the above, the cutting edge angle, which is formed by the inner cutter rotational direction at the lower end of the side wall surface of the hair introduction opening on the forefront side of the inner cutter rotational direction, is an acute angle in cross section substantially orthogonal to the length of the hair introduction opening of the outer cutter. As a result, hair that enters the hair introduction opening is pinched by the outer cutter's cutting edge, which is at the lower end of the side wall surface of the hair introduction opening and on the forefront side in the inner cutter rotational direction, and by the cutting edge of the inner cutter, and is cut. Since the cutting edge of the outer cutter has an acute angle, the hair is cut into from both sides by the acute angle cutting edge of the outer cutter and by the acute angle cutting edge of the inner cutter. As a result, the hair is cut smoothly and in good order with an improved cutting feeling.

In the present invention, the acute angle is formed on the cutting edge of only one side wall surface of the hair introduction opening of the outer cutter that is on the forefront side in the inner cutter rotational direction. In this structure, the two opposing side wall surfaces of the hair introduction opening can be made parallel planes in a slanted manner so that their lower ends are displaced into the direction opposite to the inner cutter rotating direction. In this structure, skin pressed against the shaving surface touches the slanted side wall surface and has difficulty entering deeply into the hair introduction opening, and excessively deep shaving can be prevented. This type of hair introduction openings can be obtained by bringing a thin disk-shaped rotary cutting blade with substantially the same thickness as the width of the hair introduction opening into contact with the thin layer portion in a slanted manner at an angle that is not a right angle.

In the present invention, the cutting edges at the lower ends of two opposing wall surfaces of the hair introduction openings that are defined by the neighboring ribs can take acute angles on the forefront side of the inner cutter rotational direction and on the rearward side of the inner cutter rotational direction (or on the opposite side to the inner cutter rotational direction). With this structure, ribs that make two adjacent hair introduction openings are increased in strength. In other word, since the acute-angle cutting edges project along the both lower ends of the side wall surfaces of each one of the ribs, the rigidity of the ribs increase, and it is less likely that the ribs vibrate in the inner cutter rotational direction.

In addition, since opposing cutting edges project out at the lower ends of the hair introduction opening, the skin is supported by the slanted faces of these cutting edges, and only the hair is introduced downward from between the cutting edges. Accordingly, shaving is done at appropriate depth.

Furthermore, since each hair introduction opening is wide at the top and narrow at the bottom due to the opposing projected cutting edges, skin can easily enter the hair introduction opening; and thus, it is possible to shave with appropriate depth even when the thin layer portion is thick. An outer cutter having this structure in which the opposing cutting edges project out at the lower ends of each one of the ribs can be obtained by etching, for instance, or deformation processing such as pressing. If pressing is employed, the mold that processes the rib is provided with chamfer parts that correspond to the acute cutting edge.

DETAILED DESCRIPTION OF THE INVENTION

Figure 1:
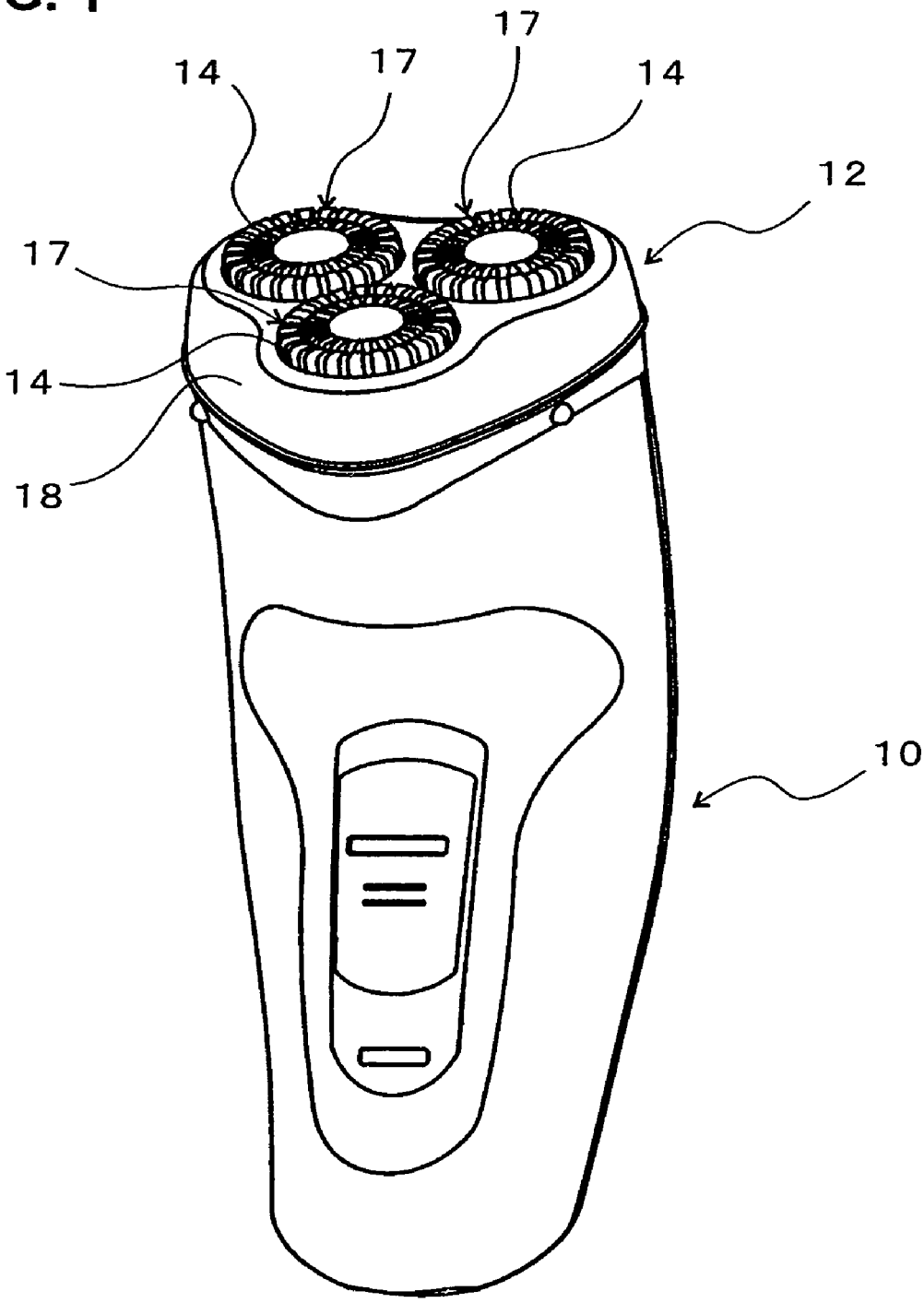
FIG. 1 is a perspective view of the rotary type electric shaver according to one embodiment of the present invention.

In FIG. 1, the reference numeral 10 is a shaver main body, and 12 is the cutter head openably or detachably attached to the upper part thereof. Three cutter units 17 each formed by an outer cutter 14 and an inner cutter 16 and so forth are installed in the cutter head 12. The outer cutters 14 corresponding to the three cutter units 17 are positioned with their centers at the vertices of an equilateral triangle.

The cutter head 12 has an outer cutter frame 18 (FIG. 1) that is openable or detachable upward relative to the shaver main body 10. The outer cutters 14 are installed in three outer cutter installation holes formed in the outer cutter frame 18. The cutter unit 17 that includes the outer cutter 14 is urged upward or in such a direction that the outer cutter 14 projects upward.

Figure 2:
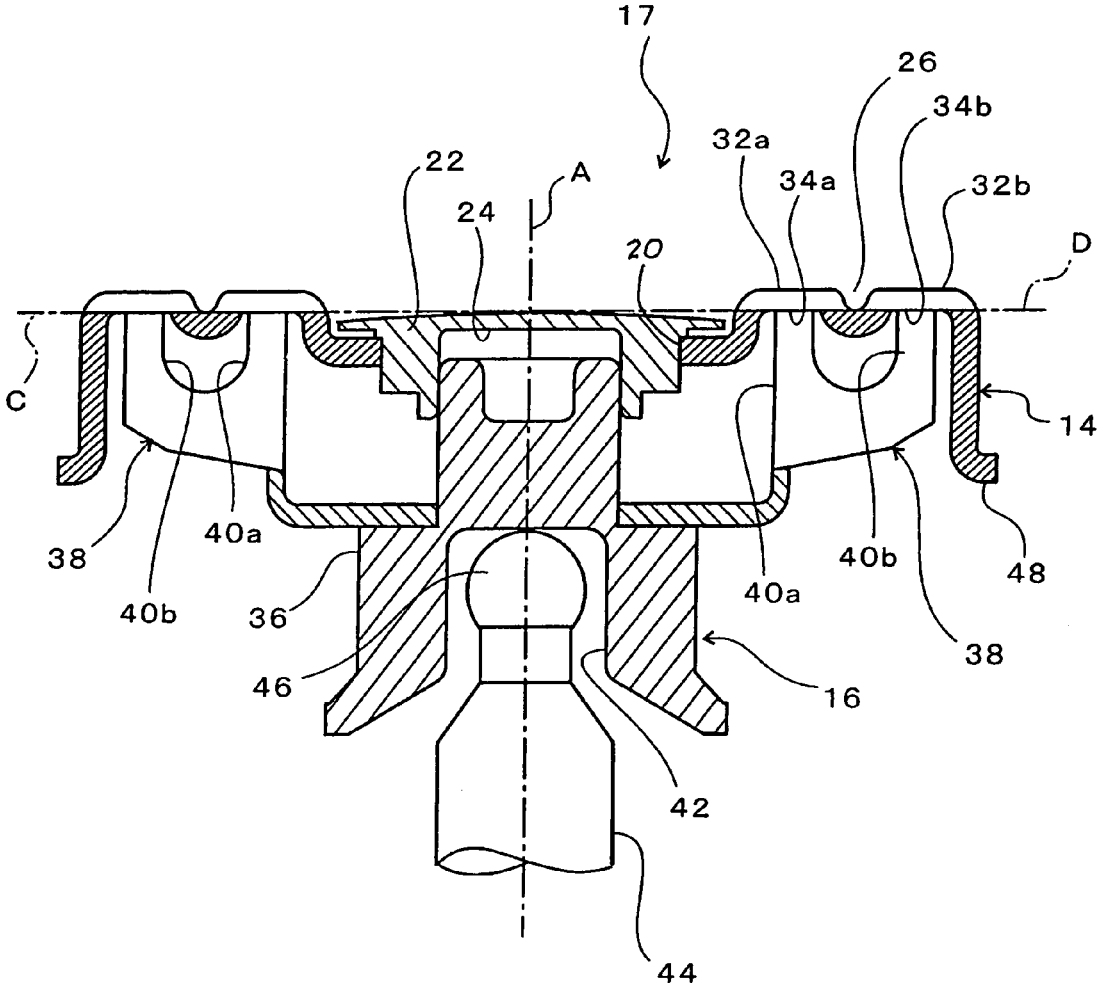
FIG. 2 is a cross-sectional side view of a cutter unit used in the shaver of the embodiment of the present invention.
Figure 3:
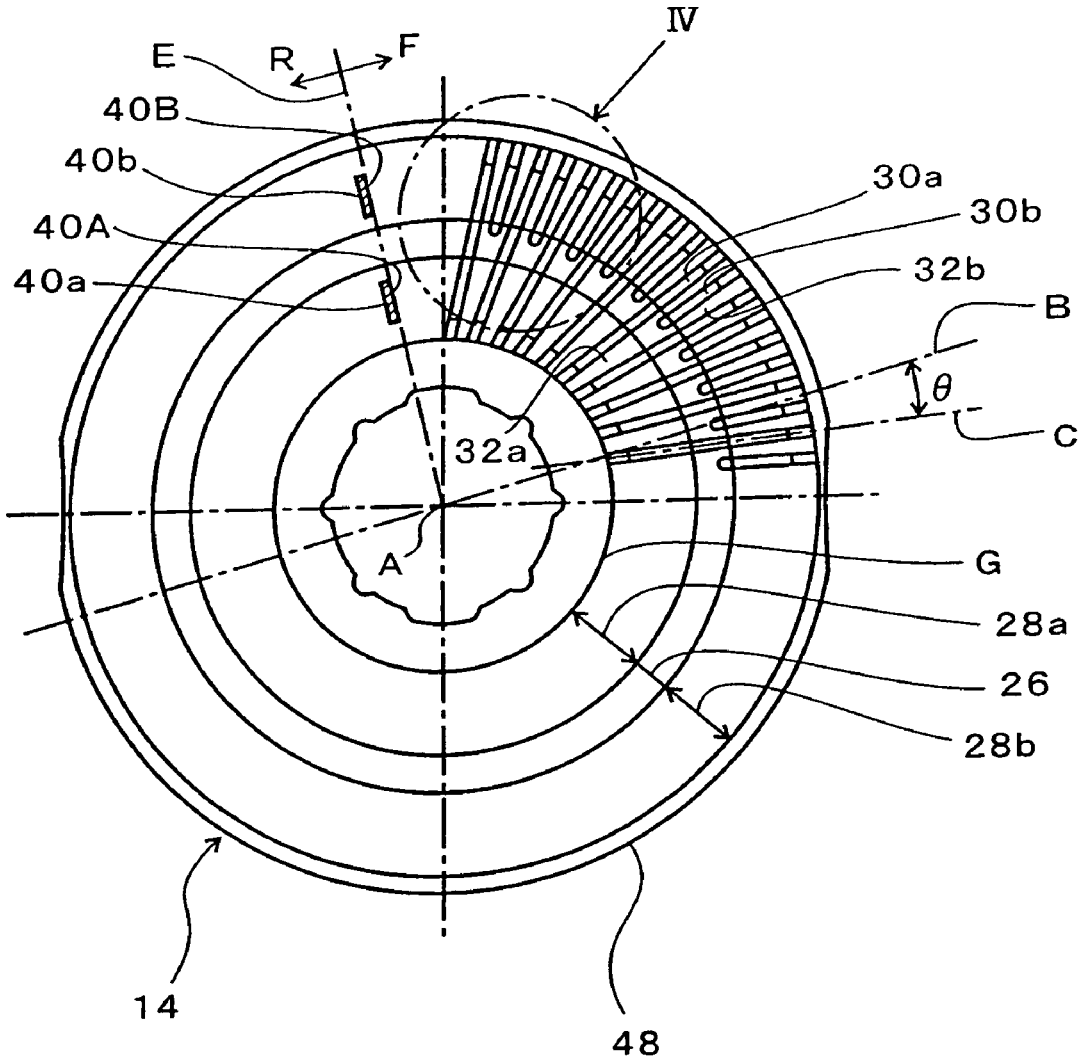
FIG. 3 is a top of the outer cutter used in the shaver of the embodiment of the present invention.

The outer cutter 14 is made of metal in which a metal plate is formed into a substantially shallow bowl shape that is convex upward (see FIGS. 2 and 3). The upper part of the outer cutter 14 is round, and a substantially circular aperture 20 is formed in the center of this circular portion. A cap 22 having an engaging hole 24 in the lower surface is fixed to this circular aperture 20 from above. The tip end of the inner cutter 16, which will be described later, engages the engaging hole 24, preventing axial vibration of the inner cutter 16.

As see from FIG. 2, a single ring-shaped groove 26 is formed in the circular upper part of the outer cutter 14, so that when viewed from above the ring-shaped groove 26 is concentric with the center axis line A that is the rotational center of the inner cutter 16. Two inside and outside ring-shaped thin layer portions 28*a* 28*b* are formed, as seen from FIG. 3, on both sides of the ring-shaped groove 26. The upper surfaces of the thin layer portions 28*a* and 28*b* make the shaving surfaces of the outer cutter 14, and their lower surfaces make the inner cutter running grooves 34*a* and 34*b*.

As shown in FIG. 3, a plurality of slit-shaped long hair introduction openings (first hair introduction openings) 30*a*, which transect both inside and outside thin layer portions 28*a* and 28*b* from the center axis line A, are formed in the outer cutter 14 in substantially the radial direction; and in addition, a plurality of hair introduction openings (second hair introduction openings) 30*b* that are shorter than the first slit-shaped hair introduction openings 30*a* are formed so as to transect only the outside thin layer portion 28*b*. More specifically, the shorter (second) hair introduction openings 30*b* are disposed to alternate with the longer (first) hair introduction openings 30*a* so as to be located between neighboring hair introduction openings 30*a* in the outside thin layer portion 28*b*.

Each of these hair introduction openings 30*a* and 30*b* are formed along a straight line C which is slanted by a constant angle θ in the rotational direction F of the inner cutter 16 on a circle G of constant radius with respect to a straight line B that extend in the radial direction of the ring-shaped thin layer portions 28*a* and 28*b* and passes through the center axis line A in FIG. 3.

Figure 4:
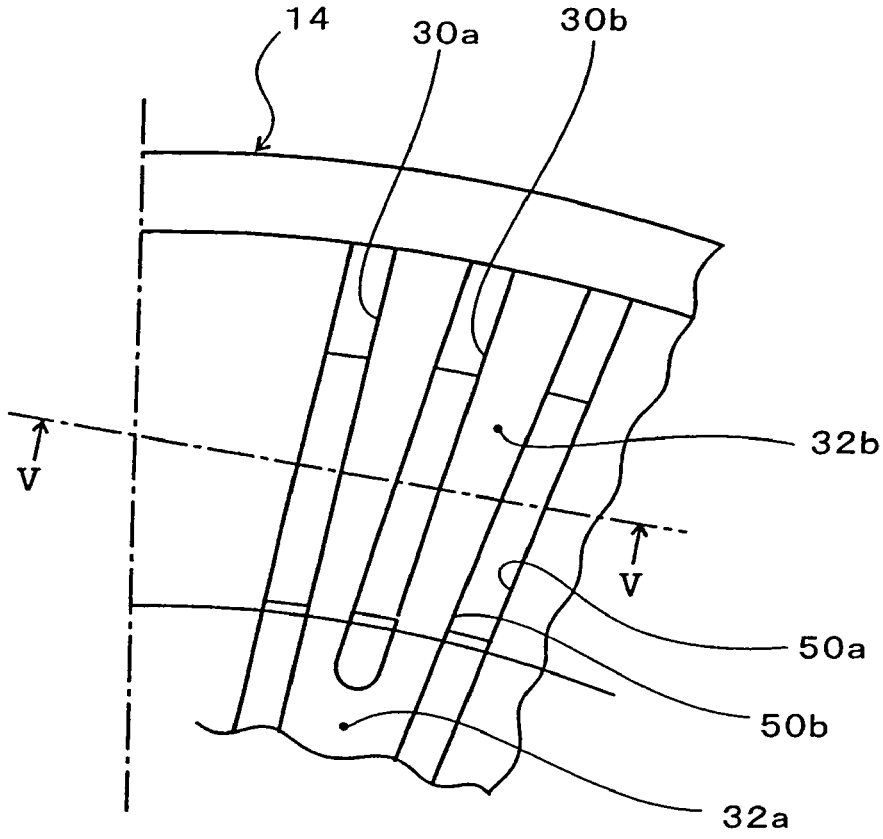
FIG. 4 is an enlarged view of the portion defined by circle IV in FIG. 3.

In addition, these hair introduction openings 30*a* and 30*b* are of constant width and are straight in the lengthwise (or longitudinal) direction as seen from FIG. 4.

The portions that are between adjacent hair introduction openings 30*a* and 30*a* on the inside thin layer portion 28*a* form ribs 32*a*, and portions between adjacent hair introduction openings 30*b* and 30*b* on the outside thin layer portion 28*b* form ribs 32*b*; and the lower surfaces of these ribs 32*a* and 32*b* work together with the inner cutter 16 and form a cutter that cuts the hair (whiskers). In other words, neighboring two ribs 32*a* define the hair introduction openings (slits) 30*a* and neighboring two ribs 32*a* and 32*b* define the hair introduction openings (slits) 30*b*; and the lower surfaces of these ribs 32*a* and 32*b* cut the hair in cooperation with the rotating inner cutter 16.

The upper surface of the outer cutter 14—more specifically, the upper surface of the ribs 32*a* and 32*b*—is on a plane orthogonal to the center axis line A (the center axis line A being perpendicular) as shown in FIG. 2; in other words, the upper surfaces of the ribs 32*a* and 32*b* are flat.

The lower surface of the thin layer portions 28*a* and 28*b* of the outer cutter 14 (more specifically, the lower surface of ribs 32*a* and 32*b*) make inner cutter running grooves (ring-shaped tracks) 34*a* and 34*b*, respectively; and these inner cutter running grooves 34*a* and 34*b* are designed such that when seen from below (from the inside) the inner surfaces (bottom surfaces) of the inner cutter running grooves 34*a* and 34*b* are located on a surface demarcated by a plane D that is orthogonal to the center axis line A. The plane D matches or corresponds to the lower surface of the ribs 32*a* and 32*b*. The lower surfaces of the ribs 32*a* and 32*b* are grinded by a whetstone, forming cutting edges at the lower edges of the ribs 32*a* and 32*b*.

The inner cutter 16 is comprised of a resin boss element 36 that opens downward and a plurality of cutter bodies 38 surrounding the boss element 36 and equidistantly fixed circumferentially. The plurality of cutter bodies 38 can be formed so as to be connected to form a ring shape. The upper portion of each one of the cutter bodies 38 divides into a bifurcated shape, forming two cutter blades 40*a* and 40*b* that make respectively sliding contact from below with the inner cutter running grooves (tracks) 34*a* and 34*b* of the outer cutter 14. The upper edges of the cutter blades 40*a* and 40*b* form cutting edges—specifically, cutting edges 40A and 40B—that are grinded horizontally along the above-described plane D.

The cutter blades 40*a* and 40*b* of the inner cutter are, as shown in FIG. 3, provided so as to be on a straight line E in the radial direction that passes through the center axis line A. Strictly speaking, the inner cutter 16 rotates in clockwise direction F in FIG. 3; and the upper edges of the cutter blades 40*a* and 40*b* on this rotational direction side F form the cutting edges 40A and 40B and are positioned on the straight line E. Accordingly, when the inner cutter 16 rotates in direction F, the shearing angle formed between the cutting edges 40A and 40B of the cutter blades 40*a* and 40*b* and the hair introduction openings 30*a* and 30*b* is equal to the slant angle θ of the hair introduction openings 30*a* and 30*b* on the circle G of a predetermined radius. The intersection positions between the cutting edges 40A and 40B and the hair introduction openings 30*a* and 30*b* move radially outward as the inner cutter 16 makes its rotation; as a result, the shearing angle (=θ) changes with the rotation of the inner cutter 16, and since such shearing angle is an acute angle that opens radially outward, the shaver (or the inner and outer cutters) makes sharp and clean cut of the hair.

In FIG. 2, an engagement hole 42 that opens downward and has a quadrilateral shape when seen in plan view is formed in the boss element 36, and a drive shaft 44 that projects from the shaver main body 10 engages this engagement hole 42. A quadrilateral spherical engagement head 46 is formed in the upper end of the drive shaft 44 and enters the engagement hole 42 of the boss element 36 from below. The drive shaft 44 is rotationally driven by a motor (not shown in the drawing) housed inside the shaver main body 10 and rotates the inner cutter 16.

The drive shaft 44 has a property of reciprocating motion in the upward projecting direction and pushes the inner cutter 16 upward. As a result, the cutter blades 40*a* and 40*b* of the inner cutter 16 elastically press the inner cutter running grooves 34*a* and 34*b* of the outer cutter 14 from below.

Furthermore, a flange 48 is formed along the lower periphery of the outer cutter 14 so as to project radially outward. The flange 48 of the outer cutter 14 engages inside an outer cutter installation hole (not shown in the drawing) formed in the outer cutter frame 18 from below. Accordingly, the cutter unit 17 that is comprised of the outer cutter 14 and the inner cutter 16 can sink downward relative to the outer cutter frame 18 with elasticity.

Next, the hair introduction openings 30*a* and 30*b* of the outer cutter 14 will be described with reference to FIG. 5.

Figure 5:
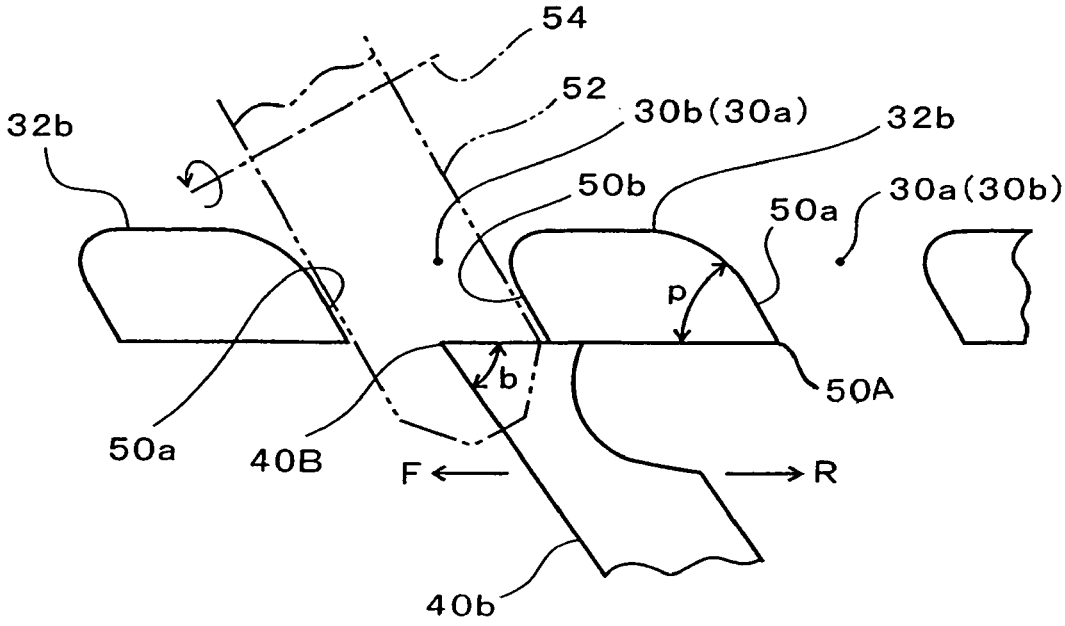
FIG. 5 is an enlarged cross-sectional view taken along the line V-V in FIG. 4.
Figure 7:
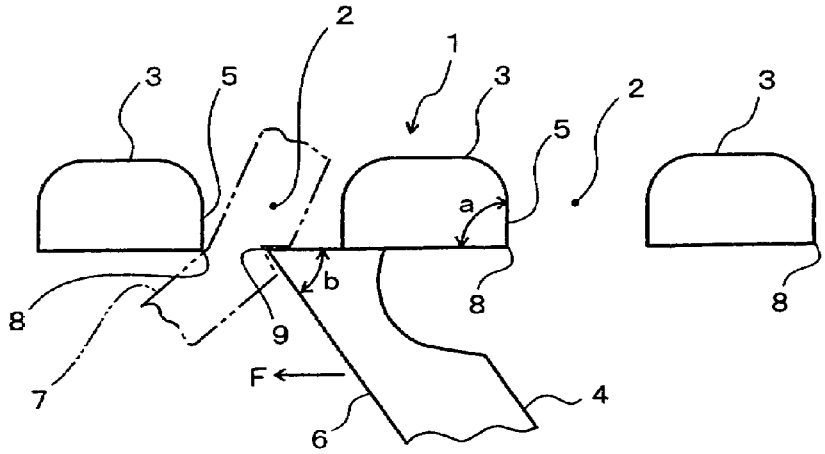
FIG. 7 PRIOR ART
FIG. 7 shows a relation ship between the inner cutter and outer cutter in a prior-art example, corresponding to the view of FIG. 5.

As seen from FIG. 5, two opposing side wall surfaces 50*a* and 50*b* in the lengthwise direction of the hair introduction openings 30*a* and 30*b* form parallel planes that are slanted, and their lower ends are displaced (with respect to the upper ends) in the direction R (or the counterclockwise direction) that is opposite from the inner cutter rotational direction F. The slant angle of the opposing side wall surfaces 50*a* and 50*b* makes the cutting edge angle p of the ribs 32*a* and 32*b* of the outer cutter 14. In other words, of the two side wall surfaces 50*a* and 50*b*, the shearing angle formed by the side wall surface 50*a* that is on the forefront side in the inner cutter rotational direction F and the lower surface of the rib 32*b* that is parallel to the inner cutter rotational direction F form the cutting edge having the cutting edge angle p, and this cutting edge angle p is an acute angle. The cutting edge angle b of the cutting edge 40B (40A) of the cutter blade 40*b* (40*a*) of the inner cutter 16 is the same as that of the conventional example shown in FIG. 7.

The hair introduction openings 30*a* and 30*b* or the ribs 32*a* and 32*b* that define the hair introduction openings 30*a* and 30*b* and have the cutting edge with angle p can be obtained by a rotary cutting blade 52 shown in FIG. 5, for instance. The rotary cutting blade 52 is in a form of a thin disk, and it has substantially the same thickness as the width of the hair introduction openings 30*a* and 30*b*. The rotational axis 54 of the rotary cutting blade 52 is brought to the top surface of the thin layer portion, so that both flat side surfaces of the rotary cutting blade 52 are at a desired acute angle (that is, at an angle p in FIG. 5) with respect to the lower surface of the thin layer portion, and then the rotary cutting blade 52 is rotated about the rotational axis 54 and moved so as to advance in the direction perpendicular to the rotational axis 54 of the rotary cutting blade 52 (from the upper surface to the lower, bottom surface of the thin layer portion) and in the lengthwise direction of the intended hair introduction opening, thus forming slanted inner wall surfaces 50*a* and 50*b* on the neighboring ribs 32*b* (32*a*) that define the hair introduction opening and have at the lower end a cutting edge 50A that is of an acute angle p. The hair introduction openings 30*a* and 30*b* can thus be processed with good efficiency.

Figure 6:
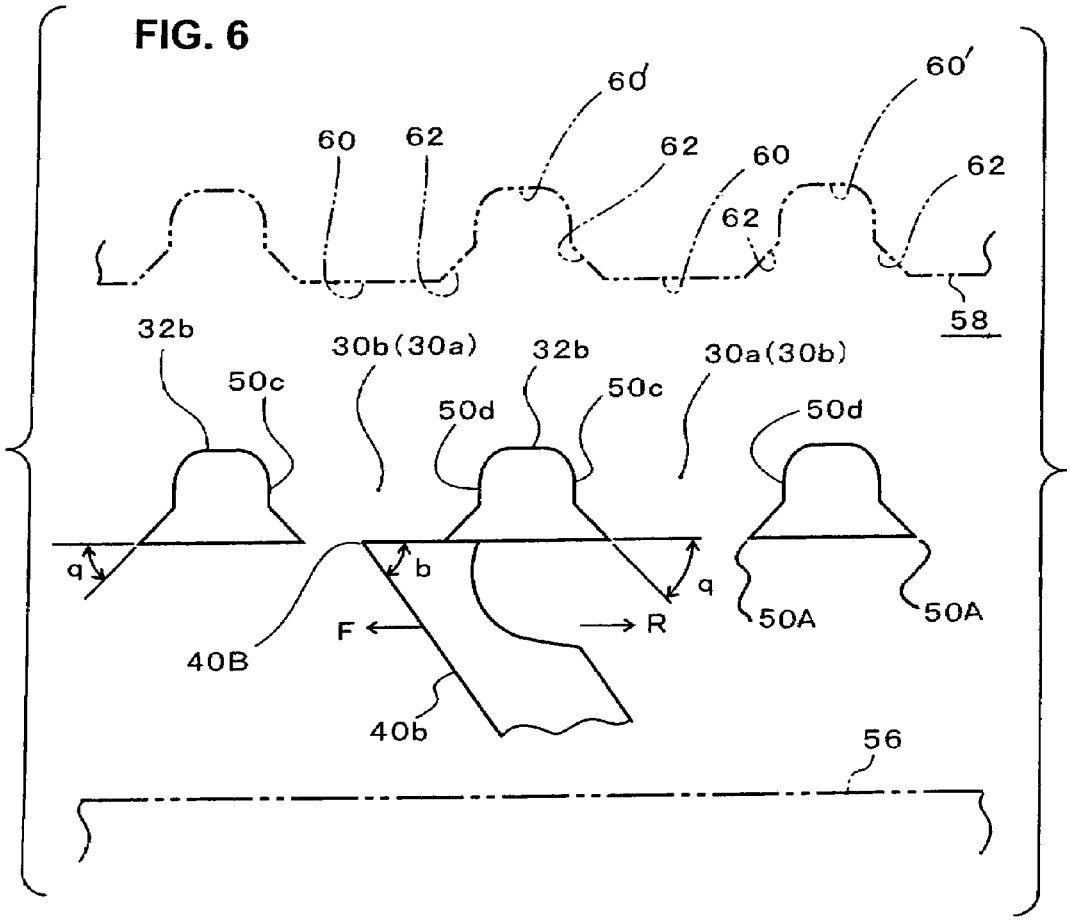
FIG. 6 illustrates in cross section the relationship between the inner cutter and outer cutter according to an embodiment of the present invention, corresponding to the view for FIG. 5.

In the outer cutter shown in FIG. 6, slanted cutting surfaces extending from lower ends of two parallel side wall surfaces 50*c* and 50*d* of the rib 32*b* (32*a*) that face the hair introduction openings 30*b* (30*a*) are formed so as to have cutting edge angles q and q of an acute angle. In other words, the slanted cutting surfaces that have the cutting edge angles q and q, which form the shearing angles between the lower ends of the ribs 32*b* (32*a*) and the cutting edges 40B (40A) of the inner cutter 16 in the inner cutter rotational direction F and in the direction R opposite to the inner cutter rotational direction F, are formed along the lower ends of the rib 32*b* (32*a*) in the lengthwise direction. In other words, the slanted cutting surfaces of the ribs 32*b* (32*a*) are formed so as to project outwardly from each other with an acute angle and are displaced (with respect to the upper ends) in the inner cutter rotational direction F and in the direction R (or the counterclockwise direction) that is opposite to the inner cutter rotational direction F, thus forming cutting edges 50A which are formed by the lower surface of the ribs 32*b* (32*a*) and the slanted cutting surface of the ribs 32*b* (32*a*) and which have an acute angle.

The hair introduction openings 30*a* and 30*b* formed by the ribs 32*a* and 32*b* having the cutting edges of acute angles q can be formed by, for instance, pressing method. In other words, in this pressing method, an upper mold 58 that has recesses 60' corresponding to the shape of the ribs 32*b* and 32*b* and chamfer parts 62 formed on both lower edges of the ridge portions 60 for processing the side walls of the ribs 32*b* and 32*a* is used; and this upper mold 58 is pressed to a flat lower mold 56 with an unfinished (blank) outer cutter in between, so that the chamfer parts 62 form the cutting edges of acute angle q.

As seen from the above, in the present invention, the cutting edge angles p (in FIG. 5) and q (in FIG. 6) in the outer cutter are respectively an acute angle. Accordingly, hair that enters the hair introduction openings 30*a* and 30*b* is pinched and cut (sheared) by the cutting edge having the acute cutting edge angle p or q formed on the ribs' side wall surface 50*a* or 50*c* that define the hair introduction openings 30*a* and 30*b* in the inner cutter rotational direction F (and in the direction R) and by the cutting edge 40B of the inner cutter 16 that has the cutting edge of acute angle b.

As seen from the above, since the cutting edge angles p and q of the outer cutter 14 and the cutting edge angle b of the inner cutter 16 are all in an acute angle, hair is cut smoothly and in good order.

Needless to say, the present invention is not limited to the structures described above. For instance, instead of straight hair introduction openings as shown in FIGS. 3 and 4, the hair introduction openings 30*a* and 30*b* can take a wave shape, a sine curve shave, a shape with regular or irregular roughness, a saw-tooth shape, etc. In order to protect the skin, however, it is preferable that a wave shape, etc. be as smooth as possible. An outer cutter with hair introduction openings of straight or non-straight shape can be processed by etching, for instance.

The outer cutter is not limited to that which has two thin layer portions 28*a* and 28*b* and inner cutter running grooves 34*a* and 34*b*; and it can be provided with a single set of the thin layer portion and inner cutter groove or with three or more sets of the thin layer portions and inner cutter grooves. Also, the shaving surface(s) on the upper surface of the outer cutter is not limited to that which is flat; and it can be formed in a curved surface that is convex upward or concave downward in vertical cross-section taken in a plane which is in the radial direction of the outer cuter and includes the center axis line A.

The invention claimed is:

1. A rotary type electric shaver comprising an outer cutter frame that is provided on a shaver main body, an outer cutter that is installed in said outer cutter frame and has hair introduction openings in its ring-shaped thin layer portion whose upper surface forms a shaving surface, and an inner cutter that has cutter bodies which make sliding contact with a lower surface of said thin layer portion and rotate to cut hair that entered said hair introduction openings, wherein a plurality of radially extending ribs in said outer cutter define said hair introduction openings to have a shape of a slit extending in said thin layer portion in substantially a radial direction thereof, and slanted cutting surfaces, provided at a lower portion of two parallel side wall surfaces of each of said ribs on both forefront and rearward sides with respect to a direction of rotation of said inner cutter, have cutting edges formed by a lower surface of the ribs and the slanted cutting surfaces and formed at an acute angle in cross section taken substantially orthogonal to a lengthwise direction of said hair introduction openings and project outwardly from said lower portion of said parallel side wall surfaces, whereby each of said plurality of radially extending ribs comprises an upper portion having said two parallel side wall surfaces with a top surface for contacting a skin of a user and a lower portion projecting outwardly from said parallel side wall surfaces and having said slanted cutting surfaces in both forefront and rearward directions with respect to a direction of rotation of said inner cutter.

2. The rotary type electric shaver of claim 1, wherein the hair introduction openings are alternately long and short in length in a radial direction of said outer cutter.

* * * * *